US011920897B2

(12) United States Patent
Zhou

(10) Patent No.: US 11,920,897 B2
(45) Date of Patent: Mar. 5, 2024

(54) UNIVERSAL TACTICAL LIGHT FIXING MECHANISM

(71) Applicant: Shenzhen Olight E-Commerce Technology Co., Ltd., Guangdong (CN)

(72) Inventor: Ziyang Zhou, Hubei (CN)

( * ) Notice: Subject to any disclaimer, the term of this patent is extended or adjusted under 35 U.S.C. 154(b) by 587 days.

(21) Appl. No.: 17/128,203

(22) Filed: Dec. 21, 2020

(65) Prior Publication Data

US 2021/0372736 A1 Dec. 2, 2021

(30) Foreign Application Priority Data

Jun. 9, 2020 (CN) ..... 202010519315.2

(51) Int. Cl.
*F41G 1/35* (2006.01)
*F41G 11/00* (2006.01)

(52) U.S. Cl.
CPC ..... *F41G 1/35* (2013.01); *F41G 11/004* (2013.01)

(58) Field of Classification Search
CPC .... F41G 11/001; F41G 11/002; F41G 11/003; F41G 11/004; F41G 11/005; F41G 11/006; F41G 1/35
USPC ..... 42/146
See application file for complete search history.

(56) References Cited

U.S. PATENT DOCUMENTS

| | | | | |
|---|---|---|---|---|
| 11,105,494 | B2 * | 8/2021 | Ma | F21L 4/00 |
| 2015/0267993 | A1 * | 9/2015 | Cheng | F41G 11/004 42/90 |
| 2021/0108891 | A1 * | 4/2021 | Ma | F41G 1/387 |
| 2021/0131651 | A1 * | 5/2021 | Ma | F21L 4/00 |

* cited by examiner

*Primary Examiner* — John Cooper

(57) ABSTRACT

This invention provides a universal tactical light fixing mechanism which includes a base, a pull rod and a lock block; the pull rod passes through the base and one end thereof is disposed inside the base; the base is provided with a mounting slot for mounting a tactical light; the pull rod is provided with a handle at one end thereof which is distant from the base for controlling the pull rod to move up and down; the handle is rotatably connected with the pull rod; the base is connected with a first screw; the lock block cooperates with the first screw to provide clamping force; the lock block is provided with a gear; the pull rod has a side surface which is provided with slots that match protruding teeth on the gear; the gear is disposed inside the base and engaged with the side surface of the pull rod.

10 Claims, 7 Drawing Sheets

UNIVERSAL TACTICAL LIGHT FIXING MECHANISM

BACKGROUND OF THE INVENTION

The present invention belongs to the technical field of tactical light technology and relates to a universal tactical light fixing mechanism.

Firearm rail is an auxiliary rail used to mount firearm accessories. In the market of long tactical light, one of the commonly used firearm rails is M-Lok firearm rail, and the other is Key-Mod firearm rail. The top parts of these two types of firearm rails are all Picatinny rails, while the sides and bottom of the M-Lok rail are M-Lok hole rails, and the sides and bottom of the Key-Mod rail are Key-Mod hole rails.

When fixing the long tactical light on the rail holes on the side or bottom surface of the firearm rail, it is generally necessary to use a tactical light fixing mechanism for the mounting, but commonly used tactical light fixing mechanism needs to be detached from the firearm rail with a screwdriver. The process for detaching the tactical light fixing mechanism is tedious and time-consuming, and requires a lot of effort to detach and mount; besides, the tactical light fixing mechanism mounted on the M-Lok hole rail and the Key-Mod hole rail often requires different bases to be replaced.

Therefore, current tactical light fixing mechanism can only be detached from the firearm rail with the help of tools, which is inconvenient and cannot be applied to the M-Lok hole rail and the Key-Mod hole rail at the same time.

BRIEF SUMMARY OF THE INVENTION

In view of the aforesaid disadvantages now present in the prior art, the present invention provides a universal tactical light fixing mechanism which can be applied to M-Lok hole rail and Key-Mod hole rail and can achieve mounting and detaching without the help of tools.

The present invention provides the following technical solutions:

A universal tactical light fixing mechanism comprises a base, a pull rod and a lock block; the pull rod passes through the base and one end thereof is disposed inside the base; the base is provided with a mounting slot for mounting a tactical light; the pull rod is provided with a handle at one end thereof which is distant from the base for controlling the pull rod to move up and down; the handle is rotatably connected with the pull rod; the base is connected with a first screw; the lock block cooperates with the first screw to provide clamping force; the lock block is provided with a gear; the pull rod has a side surface which is provided with slots that match protruding teeth on the gear; the gear is disposed inside the base and engaged with the side surface of the pull rod.

Preferably, the lock block comprises a lock rod and a pressing plate; the lock rod has a first end which is fixedly connected to the gear and a second end which is fixedly connected to the pressing plate; the pressing plate has a rectangular structure and passes through a rail hole to snap fit with a rail.

Preferably, the gear is provided with a blind hole; the blind hole has internal threads which cooperate with external threads of the first screw.

Preferably, an outer side of a screw rod of the first screw is sleeved with an annular spring plate; the annular spring plate has a first side which abuts against an inner hole surface of the base and a second side which abuts against a head of the first screw.

Preferably, the pull rod has a T-shaped structure, and comprises a horizontal plate and a vertical rod; the slots are provided on two sides of the horizontal plate; the handle is rotatably connected to the vertical rod; the vertical rod is sleeved with a spring; the spring has a first end which abuts against a bottom surface of the horizontal plate and a second end which abuts against an inner hole surface of the base.

Preferably, the vertical rod and the handle are hinged by a pin.

Preferably, the handle and the pull rod are eccentrically and axially connected.

Preferably, the base is provided with a limiting protrusion on one side close to rail holes, and the limiting protrusion is used to abut against opposite sides of two adjacent rail holes.

Preferably, a second screw is connected to the mounting slot; the second screw passes through the mounting slot to cooperate with internal threads of a mounting base of a tactical light.

Preferably, the base comprises a first side plate and a second side plate; a first angle between the first side plate and the second side plate is equal to a second angle between a rail hole surface of a firearm rail and an adjacent side surface thereof; the second side plate is mounted on the rail hole surface; the first side plate is mounted on the side surface adjacent to the rail hole surface; the mounting slot is disposed on the first side plate; the pull rod is provided on the second side plate.

The beneficial effects of the present invention are as follows: The present invention provides a universal tactical light fixing mechanism, wherein mounting and detaching of the tactical light fixing mechanism is achieved by first turning the handle to drive the pull rod on the base to move, so that the pull rod engages with the lock block and drives the lock block to rotate to control the rotation of the lock block. In the present invention, the mounting and detaching of the mechanism can be achieved by simply turning the handle. Besides, the present invention is applicable for both the M-Lok hole rail and the Key-Mod hole rail. It is convenient and do not need much effort to perform mounting and detaching. The rectangular structure of the pressing plate makes it possible to mount and detaching the lock block by rotating the pressing plate. There is no need to replace the base when mounting on different types of rail holes, thus the applicability is high. The annular spring plate makes the tactical light fixing mechanism more stable and difficult to sway. The spring on the pull rod makes the mounting and detaching processes easier and more convenient. The base is provided with a limiting protrusion to limit the forward and backward movement of the base and thus further improves the stability of the mechanism. The base is provided with a first side plate and a second side plate. By forming an angle between the first side plate and the second side plate, the tactical light could fit more closely with the firearm, and thereby weakening the disharmony of the tactical light as mounted on the firearm.

Figure 1:
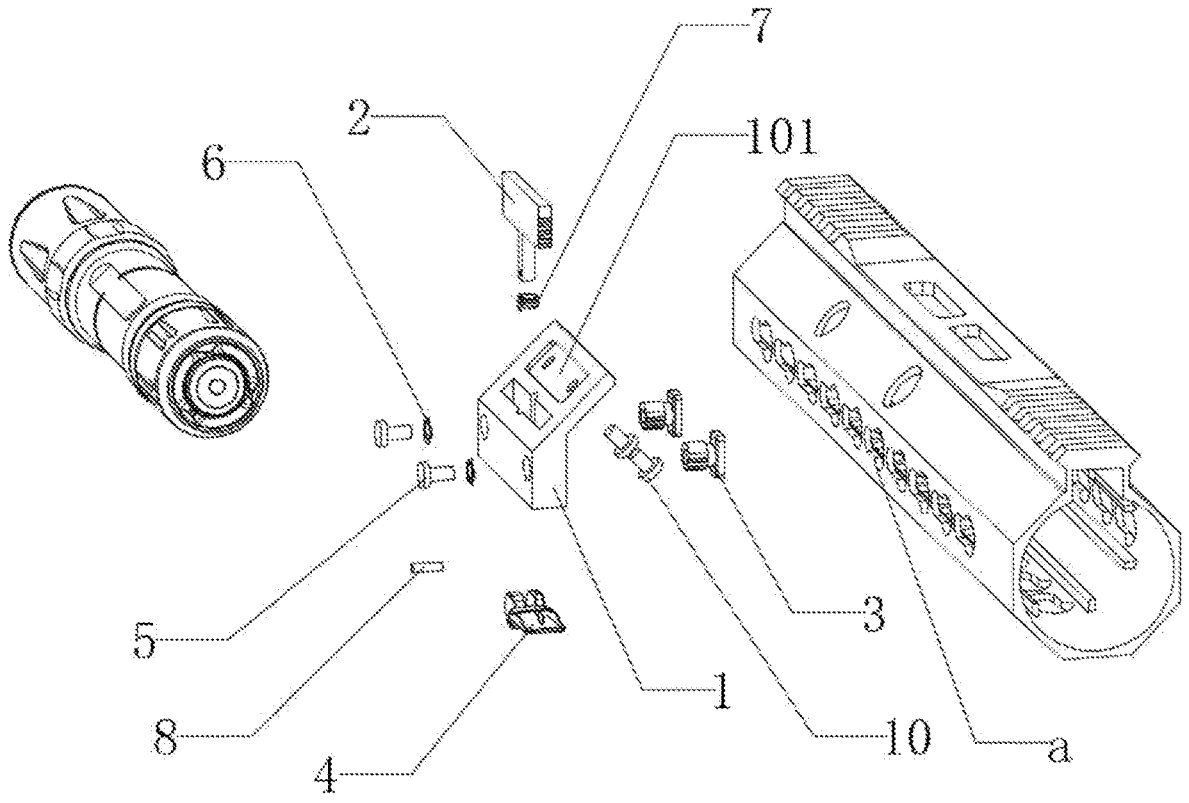
FIG. 1 is an exploded view of the tactical light fixing mechanism.

References in the figures: 1—base; 2—pull rod; 3—lock block; 4—handle; 5—first screw; 6—annular spring plate; 7—spring; 8—pin; 9—limiting protrusion; 10—second screw; 101—mounting slot; 201—horizontal plate; 301—gear; 302—lock rod; 303—pressing plate; 401—cam; a—Key-Mod rail hole; b—M-Lok rail hole; c—tactical light; D—mounting base.

DETAILED DESCRIPTION OF THE INVENTION

Some embodiments of the present invention are further described in detail below. The embodiments are illustrated in the figures. Identical or like references throughout the description and the figures represent identical or like components or components having the same or similar functions. The embodiments described below with reference to the figures should be considered illustrative for the purpose of explaining the technical features of the present invention, and should not be considered as any limitation to the present invention.

In the present invention, it should be noted that directions or positional relationships indicated by terms such as "length", "width", "upper", "lower", "front", "rear", "left", "right", "vertical", "horizontal", "top", "bottom", "inner", "outer" should be understood based on the directions or positional relationships according to the figures, and should also be understood as merely means for simplification for the sake of easier illustration of the present invention. It is not meant or intended to mean that the devices or components concerned should have such specifically described directions, or should be configured or operated according to the specifically described directions, and hence should not be considered as any limitation to the present invention.

Further, terms like "first", "second" are used for illustrative purpose, and should not be understood as meaning or implying relative importance or as a subtle indication of a quantity of the described technical feature. Therefore, a feature defined by "first" or "second" may comprises by obvious indication or subtle implication, one or more than one of said feature in terms of quantity. In the description, "a plurality of" means a quantity of two or above, unless otherwise specified.

In the present invention, unless otherwise specified, terms such as "mount", "connect", "communicate" and "fix" should be understood broadly. For example, a fixed connection, a removable connection, or integral formation may be intended. Further, connection may be mechanical or electrical, direct or indirect through a medium, and may be an internal communication between two components or an interactive relationship between two components. A person skilled in this field of art should be able to understand the specific meaning of the terms described in the present invention according to the context of the practical situation described.

With reference to FIGS. 1 to 8, the present invention provides a universal tactical light fixing mechanism which comprises a base 1, a pull rod 2 and lock blocks 3. The pull rod 2 passes through the base 1 and one end thereof is disposed inside the base 1. The base 1 is provided with a mounting slot 101 for mounting a tactical light; the pull rod 2 is provided with a handle 4 at one end thereof which is distant from the base 1 for controlling the pull rod 2 to move up and down. The handle 4 is rotatably connected with the pull rod 2; the base 1 is connected with first screws 5; each of the lock blocks 3 cooperates with the first screws 5 to provide clamping force; each of the lock blocks 3 is provided with a gear 301; the pull rod 2 has side surfaces which are provided with slots that match protruding teeth on the gears 301 respectively; the gears 301 are disposed inside the base 1 and engaged with the side surfaces of the pull rod 2. By turning the handle 4, the pull rod 2 is moved up and down in the vertical direction. While the pull rod 2 is moving, it engages and drives the lock blocks 3 to rotate axially. Turn the handle 4 in the forward direction so that when the lock blocks 3 are rotated at a certain angle, the lock blocks 3 extend into the rail hole; then turn the handle 4 in the reverse direction, thereby rotating the lock blocks 3 in the reverse direction at the same time so that the lock blocks 3 are stuck at one side of the rail hole. The fixing mechanism is mounted on the firearm rail by the clamping force between the first screws 5 and the lock blocks 3. In the present invention, by turning the handle 4, the mechanism can achieve mounting and detaching without the use of other tools. The base 1 and the firearm rail can be clamped by the lock blocks 3 and the screws in cooperation. Both the two different types of firearm rails (M-lok firearm rail and Key-Mod firearm rail) are applicable.

Figure 2:
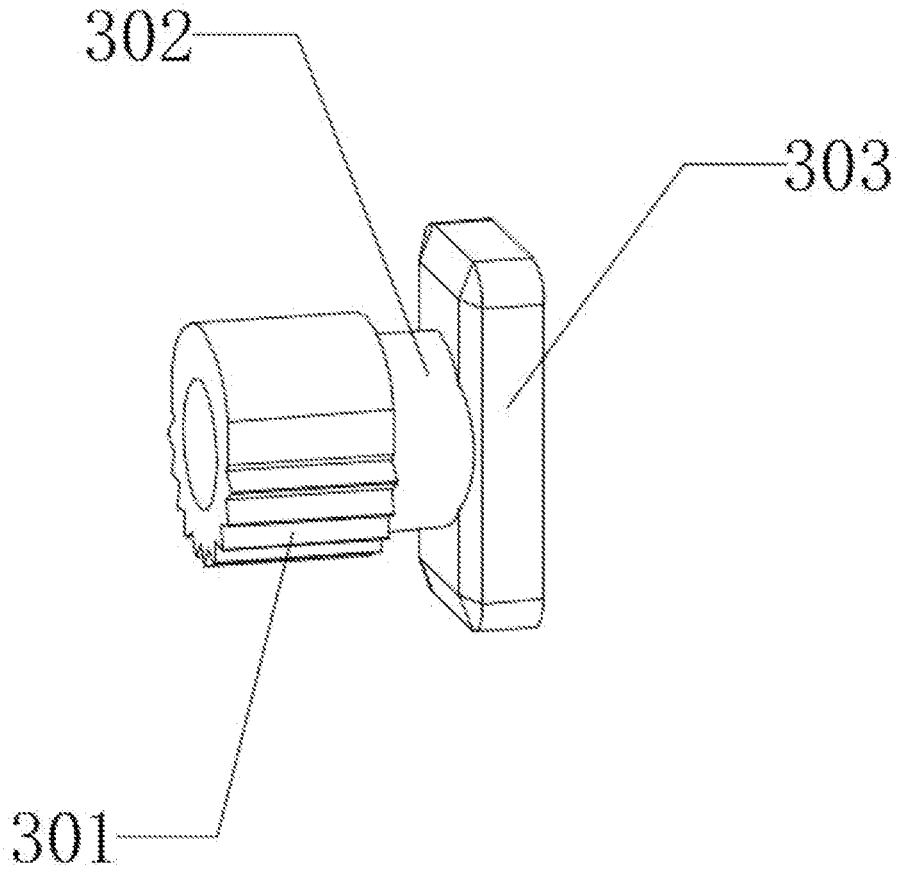
FIG. 2 is a schematic structural view of the lock block.
Figure 3:
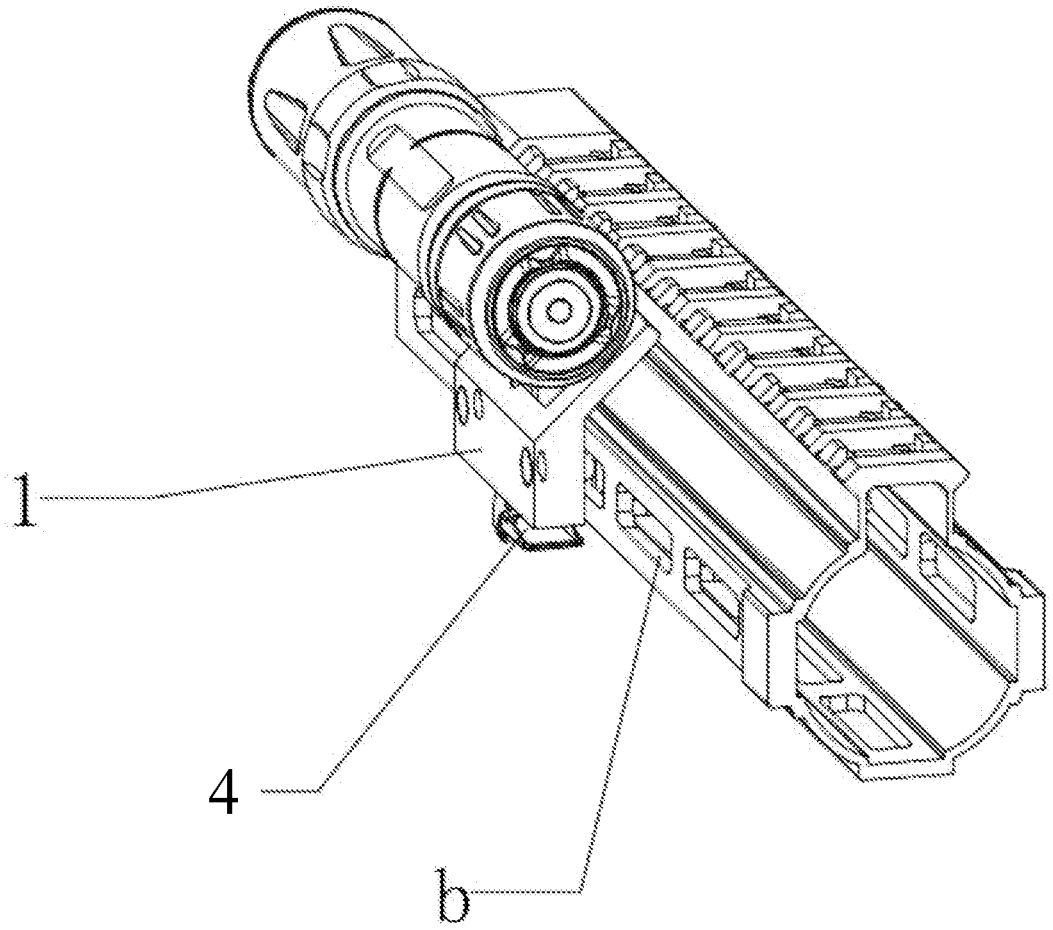
FIG. 3 is a schematic view of the tactical light fixing mechanism as mounted on M-Lok rail holes.
Figure 4:
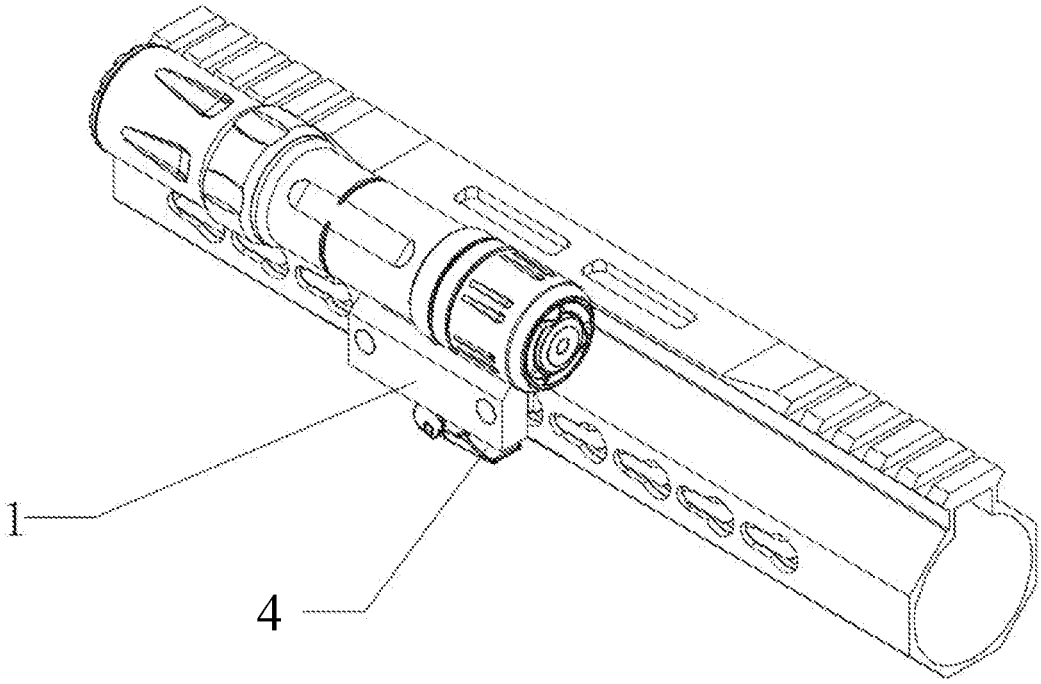
FIG. 4 is a schematic view of the tactical light fixing mechanism as mounted on Key-Mod rail holes.
Figure 5:
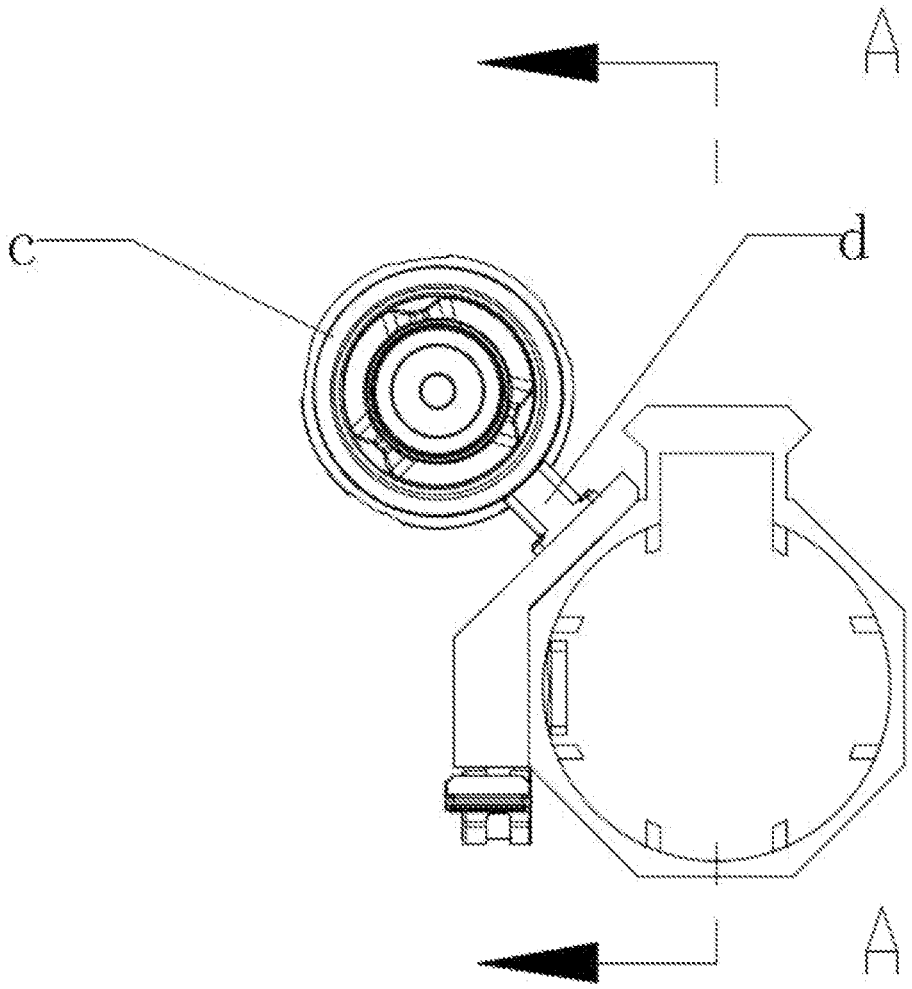
FIG. 5 is a schematic front view of the tactical light fixing mechanism.
Figure 6:
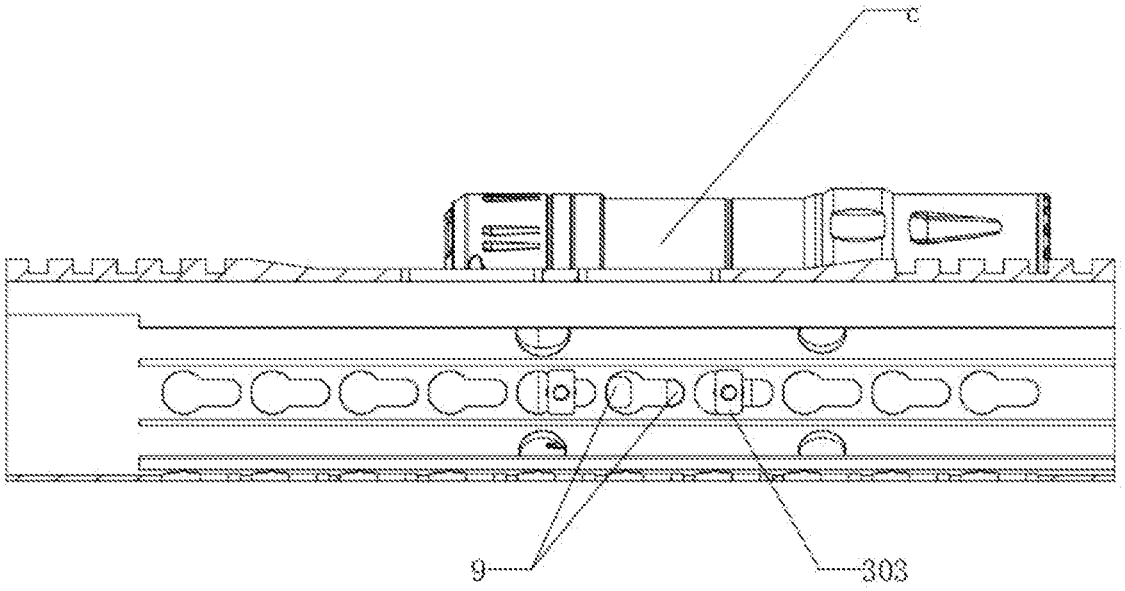
FIG. 6 is a cross-sectional view along A-A of FIG. 5.

As shown in FIG. 2 and FIGS. 5 to 6, in this embodiment, each of the lock blocks 3 comprises a lock rod 302 and a pressing plate 303. The lock rod 302 has a first end which is fixedly connected to the gear 301 and a second end which is fixedly connected to the pressing plate 303. The pressing plate 303 has a rectangular structure. The pull rod 2 engages with the gear 301 to drive the gear 301 to rotate, thereby also rotating the pressing plate 303. The pressing plate 303 has a rectangular structure. When the two long sides of the pressing plate are rotated to be parallel to the longitudinal direction of the rail hole, the pressing plate 303 can pass through the rail hole and enter into the firearm rail, and the pressing plate 303 is then rotated in the reverse direction to be fixed on the inner side of the firearm rail. In this embodiment, when the long sides of the pressing plate 303 are perpendicular to the longitudinal direction of the rail hole, the pressing plate 303 is stuck on the inner side of the firearm rail. When the long sides of the pressing plate 303 are parallel to the longitudinal direction of the rail hole, the pressing plate 303 can enter into and exit from the firearm rail through the rail hole.

In some embodiments, the pressing plate 303 can also be elliptical in shape. When the pressing plate 303 is rotated so that the long axis of the ellipse is parallel to the longitudinal direction of the rail hole, the pressing plate 303 can enter into the rail hole; then the pressing plate 303 is rotated in the reverse direction; when the short axis of the ellipse intersects or is perpendicular to the longitudinal direction of the rail hole, the pressing plate 303 is stuck on one side of the rail hole.

In this embodiment, the size of the pressing plate 303 can be adjusted according to the size of the rail hole of the firearm rail. In this embodiment, when the tactical light fixing mechanism is mounted on the M-Lok firearm rail, the distance between the two long sides of the pressing plate 303 (that is, the width of the pressing plate) is smaller than the width of the M-Lok rail hole and/or Key-Mod rail hole; the length of the two long sides of the pressing plate 303 is greater than the width of the M-Lok rail hole and/or Key-Mod rail hole and smaller than the length of the M-Lok rail hole and/or Key-Mod rail hole. In this embodiment, the size of the M-Lok rail hole and the Key-Mod rail hole can be determined in advance for calculating the size of the pressing plate 303 that can suit the two types of rail holes. The tactical light fixing mechanism can be mounted on either the M-Lok rail hole or the Key-Mod rail hole. When the mechanism needs to be transferred from one type of firearm rail to another, there is no need to replace the base, thereby achieving quick mounting and detaching and high degree of applicability.

In this embodiment, the gear 301, the lock rod 302 and the pressing plate 303 are an integral structure. In some embodiments, the gear 301, the lock rod 302 and the pressing plate 303 may also be connected by welding.

In this embodiment, the gear 301 is provided with a blind hole; the blind hole has internal threads which cooperate with external threads of the first screw 5. The outer side of the screw rod of each the first screws 5 is sleeved with an annular spring plate 6. The annular spring plate 6 has a first side which abuts against the inner hole surface of the base 1 and a second side which abuts against the head of the first screw 5. During mounting, turn the handle 4 to rotate the lock blocks 3 to put the lock blocks 3 into the rail hole, and then turn the handle 4 in the opposite direction; the annular spring plates are compressed and the first screws 5 are pushed back. The clamping force between the first screws 5 and the lock blocks 3 increases under the reverse thrust of the annular spring plates, so that the tactical light fixing mechanism can be firmly mounted on the firearm rail and is difficult to sway.

Figure 7:
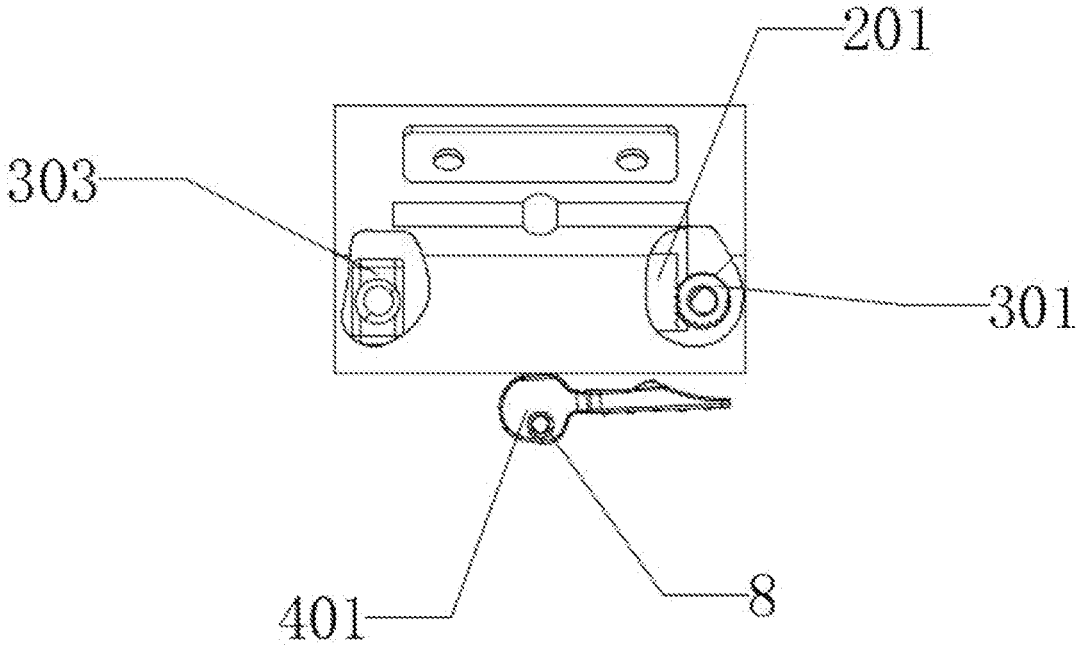
FIG. 7 is a schematic diagram of the locked state of the tactical light fixing mechanism.
Figure 8:
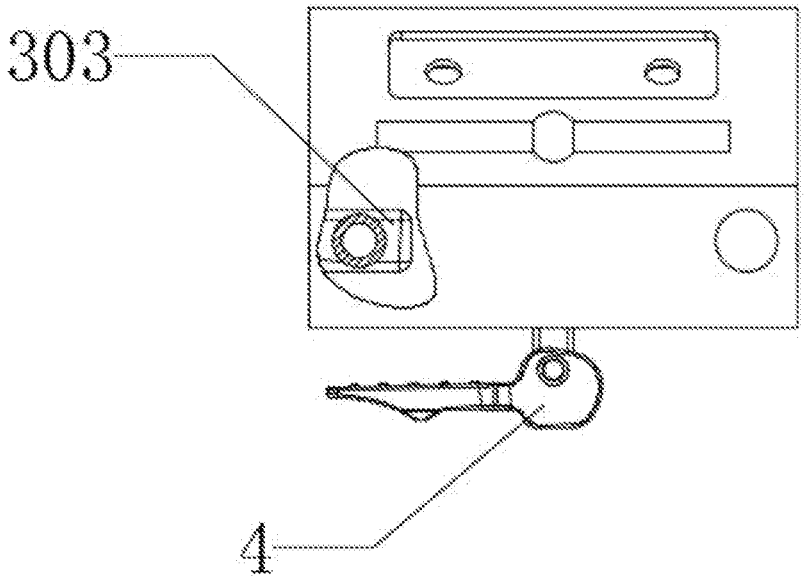
FIG. 8 is a schematic diagram of a released state of the tactical light fixing mechanism.

As shown in FIGS. 2 and 7, in this embodiment, the pull rod 2 is has a T-shaped structure. The pull rod 2 comprises a horizontal plate 201 and a vertical rod. The slots are provided on two sides of the horizontal plate 201. The handle 4 is hinged to the vertical rod by a pin 8. Turning the handle 4 pulls the vertical rod to move up and down. While the horizontal plate 201 moves up and down, the slots on the sides engage and drive the lock blocks 3 to rotate. The vertical rod is also sleeved with a spring 7. The spring 7 has a first end which abuts against a bottom surface of the horizontal plate 201 and a second end which abuts against an inner hole surface of the base 1. When the vertical rod moves downward under a force, the spring 7 is compressed, and the horizontal plate 201 is pushed upward by the spring 7. The spring 7 provided on the pull rod 2 saves effort when turning the handle 4 and makes the mounting and detaching processes easier and faster.

In this embodiment, the base 1 is also provided with limiting protrusions 9 on the side close to the rail hole. Each of the limiting protrusions 9 abuts against opposite sides of two adjacent rail holes to further stabilize the tactical light fixing mechanism, so that the mechanism cannot move back and forth on the firearm rail, thereby enhancing the stability of the mechanism. In this embodiment, there are two limiting protrusions 9, and the size, spacing distance and shape of the limiting protrusions 9 can be appropriately adjusted according to the distance, size and type of the adjacent rail holes.

In this embodiment, second screws 10 are connected to the mounting slot 101; the second screws 10 passes through the mounting slot 101 to cooperate with internal threads of the mounting base d of the tactical light. The mounting base d is provided on the tactical light, and the mounting base d is inserted in the mounting slot 101 to cooperate with the second screws 10 to fixedly mount the tactical light on the base 1.

As shown in FIGS. 1 to 4, in this embodiment, the base 1 comprises a first side plate and a second side plate; a first angle between the first side plate and the second side plate is equal to a second angle between a rail hole surface of a firearm rail and an adjacent side surface thereof; the second side plate is mounted on the rail hole surface; the first side plate is mounted on the side surface adjacent to the rail hole surface; the mounting slot 101 is disposed on the first side plate; the pull rod 2 is provided on the second side plate. It is common for tactical lights to be mounted on the rail holes on the left and right sides; in this way, the tactical lights protrude from one side of the firearm rail after mounting. The tactical lights are relatively obtrusive and easily hooked to branches or other debris. In this embodiment, the base 1 is provided with a first side plate and a second side plate. The second side plate is used to mount the mechanism on the rail hole, and the first side pate is used to mount the tactical light, thus making the tactical light and the firearm fit better and optimizing the user's experience.

In this embodiment, the handle 4 and the pull rod 2 are eccentrically and axially connected. The end of the handle 4 connected with the pull rod 2 is a cam 401. When the handle 4 is in the position shown in FIG. 7, the handle 4 is parallel to the bottom of the base 1, and the mechanism can maintain a stable locked state. When the handle 4 is in the position shown in FIG. 8, the handle 4 is in a completely released state. During mounting, the handle 4 is in a completely released state; put the lock blocks 3 into the rail hole, then turn the handle 180° counterclockwise so that the handle 4 drives the pull rod 2 to move downwards, and the pull rod 2 engages and drives the lock blocks 3 to rotate 90°; the lock blocks 3 are then stuck in the rail; the annular spring plates are compressed by force, and the first screws 5 are pushed back. The first screws 5 and the lock blocks 3 cooperate to mount the mechanism on the rail hole. When detaching, turn the handle 180° clockwise; the pull rod 2 is driven by the spring 7 to move upwards, thereby driving the lock blocks 3 to rotate 90°, and the lock blocks 3 are removed from the rail hole to complete the detaching.

The description above illustrates only one of the more preferred embodiments of the present invention. Ordinary changes and replacements made within the scope of teachings of the present invention by a person skilled in the art should also fall within the scope of the present invention.

What is claimed is:

1. A universal tactical light fixing mechanism comprising a base (1), a pull rod (2) and a lock block (3); the pull rod (2) passes through the base (1) and one end thereof is disposed inside the base (1); the base (1) is provided with a mounting slot (101) for mounting a tactical light; the pull rod (2) is provided with a handle (4) at one end thereof which is distant from the base (1) for controlling the pull rod (2) to move up and down; the handle (4) is rotatably connected with the pull rod (2); the base (1) is connected with a first screw (5); the lock block (3) cooperates with the first screw (5) to provide clamping force; the lock block (3) is provided with a gear (301); the pull rod (2) has a side surface which is provided with slots that match protruding teeth on the gear (301); the gear (301) is disposed inside the base (1) and engaged with the side surface of the pull rod (2).

2. The universal tactical light fixing mechanism as in claim 1, wherein the lock block (3) comprises a lock rod (302) and a pressing plate (303); the lock rod (302) has a first end which is fixedly connected to the gear (301) and a second end which is fixedly connected to the pressing plate (303); the pressing plate (303) has a rectangular structure and passes through a rail hole to snap fit with a rail.

3. The universal tactical light fixing mechanism as in claim 1, wherein the gear (301) is provided with a blind hole; the blind hole has internal threads which cooperate with external threads of the first screw (5).

4. The universal tactical light fixing mechanism as in claim 1, wherein an outer side of a screw rod of the first screw (5) is sleeved with an annular spring plate (6); the annular spring plate (6) has a first side which abuts against an inner hole surface of the base (1) and a second side which abuts against a head of the first screw (5).

5. The universal tactical light fixing mechanism as in claim 1, wherein the pull rod (2) has a T-shaped structure, and comprises a horizontal plate (201) and a vertical rod; the slots are provided on two sides of the horizontal plate (201); the handle is rotatably connected to the vertical rod; the vertical rod is sleeved with a spring (7); the spring (7) has a first end which abuts against a bottom surface of the horizontal plate (201) and a second end which abuts against an inner hole surface of the base (1).

6. The universal tactical light fixing mechanism as in claim 5, wherein the vertical rod and the handle are hinged by a pin (8).

7. The universal tactical light fixing mechanism as in claim 1, wherein the handle (4) and the pull rod (2) are eccentrically and axially connected.

8. The universal tactical light fixing mechanism as in claim 1, wherein the base is provided with a limiting protrusion (9) on one side close to rail holes, and the limiting protrusion (9) is used to abut against opposite sides of two adjacent rail holes.

9. The universal tactical light fixing mechanism as in claim 1, wherein a second screw (10) is connected to the mounting slot (101); the second screw (10) passes through the mounting slot (101) to cooperate with internal threads of a mounting base of a tactical light.

10. The universal tactical light fixing mechanism as in claim 1, wherein the base (1) comprises a first side plate and a second side plate; a first angle between the first side plate and the second side plate is equal to a second angle between a rail hole surface of a firearm rail and an adjacent side surface thereof; the second side plate is mounted on the rail hole surface; the first side plate is mounted on the side surface adjacent to the rail hole surface; the mounting slot (101) is disposed on the first side plate; the pull rod (2) is provided on the second side plate.

* * * * *